US006540113B2

(12) United States Patent
Gardos

(10) Patent No.: US 6,540,113 B2
(45) Date of Patent: Apr. 1, 2003

(54) FLUID DISPENSER PARTICULARLY ADAPTED FOR HAND-HELD OPERATION

(75) Inventor: Ivan Gardos, Shrewsbury, MA (US)

(73) Assignee: Dispensing Technologies International Corporation, Clinton, MA (US)

( * ) Notice: Subject to any disclaimer, the term of this patent is extended or adjusted under 35 U.S.C. 154(b) by 48 days.

(21) Appl. No.: 09/775,068

(22) Filed: Feb. 1, 2001

(65) Prior Publication Data

US 2002/0130141 A1 Sep. 19, 2002

(51) Int. Cl.[7] ..... B67D 5/52

(52) U.S. Cl. ..... 222/137; 222/145.5; 222/326; 222/333

(58) Field of Search ..... 222/137, 145.5, 222/145.6, 326, 327, 333, 386

(56) References Cited

U.S. PATENT DOCUMENTS 3,931,914 A * 1/1976 Hosaka et al. ..... 222/333
4,335,834 A * 6/1982 Zepkin ..... 222/327
4,583,934 A * 4/1986 Hata et al. ..... 222/327
5,203,476 A * 4/1993 Keller ..... 222/136
5,341,958 A * 8/1994 Bayat et al. ..... 222/333
5,450,988 A * 9/1995 Jerdee ..... 222/333
5,503,307 A * 4/1996 Wilson et al. ..... 222/326
5,556,009 A * 9/1996 Motzko ..... 192/125 A
5,762,239 A * 6/1998 Cossette ..... 222/326
5,875,928 A * 3/1999 Muller et al. ..... 222/137
5,909,830 A * 6/1999 Bates et al. ..... 222/327
6,089,407 A * 7/2000 Gardos ..... 222/1
6,123,235 A * 9/2000 Hsu ..... 192/69.7

* cited by examiner

*Primary Examiner*—Joseph A. Kaufman
(74) *Attorney, Agent, or Firm*—Rines and Rines

(57) ABSTRACT

An improved electric motor-operated, preferably hand-held, fluid dispenser, using in-line longitudinal drive racks and fluid cartridge containers dispensed by the racks, the driving (and retraction) being controlled through the use of a flat (pancake) coil spring, and the cartridge containers being mountable in an adjustable cartridge holder for accommodating different-shaped rear cartridge mounting flanges.

9 Claims, 7 Drawing Sheets

FLUID DISPENSER PARTICULARLY ADAPTED FOR HAND-HELD OPERATION

The present invention relates to the dispensing of viscous cartridge-packaged fluid materials and the like for industrial and other applications, including also dental materials such as high viscosity impression materials and also other fluid materials such as washes and crown-and-bridge materials, and the like, currently packaged in dual cartridges for hand-controlled and hand-held dispensing guns and the like.

BACKGROUND OF INVENTION

More particularly, the invention is concerned with hand-held fluid cartridge dispensers that are electrically operated and are of the type described in my earlier U.S. Pat. No. 6,089,407, issued Jul. 18, 2000, for Electrically Powered Fluid-Dispensing Apparatus and Method Particularly Adapted For Hand gun Operation, using battery or mains—power, and preferably employing rack and pinion drives for engaging push pads carried at the ends of longitudinal racks with the piston plugs or plungers of fluid-filled cartridges positioned in chambers extending longitudinally in line with and forward of the racks and terminating in a fluid dispensing orifice. Upon the expelling of the fluid from the cartridges through the dispensing orifice, a spring return retracts the racks, and new cartridges are inserted into the cartridge chamber.

While such apparatus has been found to be functionally successful in use, there are occasions, particularly with certain ranges of fluid viscosities, when more forceful and rapid return of the racks after the dispensing of the fluid from the cartridges is desirable and, indeed, required. Additionally, with the advent of different designs of longitudinal fluid-containing cartridges of standardized diameter and, more especially, different-shaped cartridge rear end mounting flanges, and, sourcing of cartridges from an expanding number of different cartridge manufacturers using widely different types of fluid materials for a myriad of different usages, the need for a universal holder mechanism for accommodating for such different-shaped cartridge end flanges has become important, to enable a single dispenser gun to accommodate all types of such cartridges.

It is to the providing of these important improvements, accordingly, that the present invention is primarily directed.

OBJECTS OF INVENTION

It is therefore a principal object of the present invention to provide a new and improved preferably hand dispenser apparatus for the dispensing of a wide variety of cartridge-packaged fluids and the like that shall not be subject to the above-described limitations, but, rather, shall enable rapid and positive retraction of rack push pads and universality of usage of the gun with multiple-shaped cartridge end mounting flanges.

A further object is to provide such an improved electrically powered hand-held dispenser that is particularly, though not exclusively, adapted to be used by dentists and the like.

Other and further objects will be explained hereinafter and are more particularly delineated in the appended claims.

SUMMARY

In summary, however, the invention embraces in an electric motor-driven fluid-filled cartridge dispenser wherein longitudinal racks are driven forward within a fixed rack guide to force the fluid in the cartridges to be dispensed, apparatus having, in combination, motor, reducing and drive gears; the drive gear being adapted to move the rack longitudinally, and the motor gear being driven by an electric motor; the reducing gear being mounted to be driven when engaged by the motor gear and driving the drive gear to move the rack; a flat coil spring secured at one end to the top of the rack guide and connected at its other end to the reducing gear so as to be tensioned as the motor gear is spring—urged into engagement with the reducing gear and drives the reducing gear, and to be released upon disengagement from the motor gear; and a spring-controlled release mechanism actuable upon the dispensing of the fluid from the cartridges for disengaging the motor gear from the reducing gear to enable the coil spring retraction of the racks longitudinally within the rack guide.

Preferred and best mode embodiments and designs are hereinafter explained in detail.

DRAWINGS

The invention will now be described in connection with the accompanying drawings wherein:

FIG. 1 it is an isometric view of a preferred apparatus design of the invention employing also the principles of my said earlier patent, with parts shown exploded to illustrate the details of construction;

DESCRIPTION OF PREFERRED EMBODIMENT OF INVENTION

Figure 1:
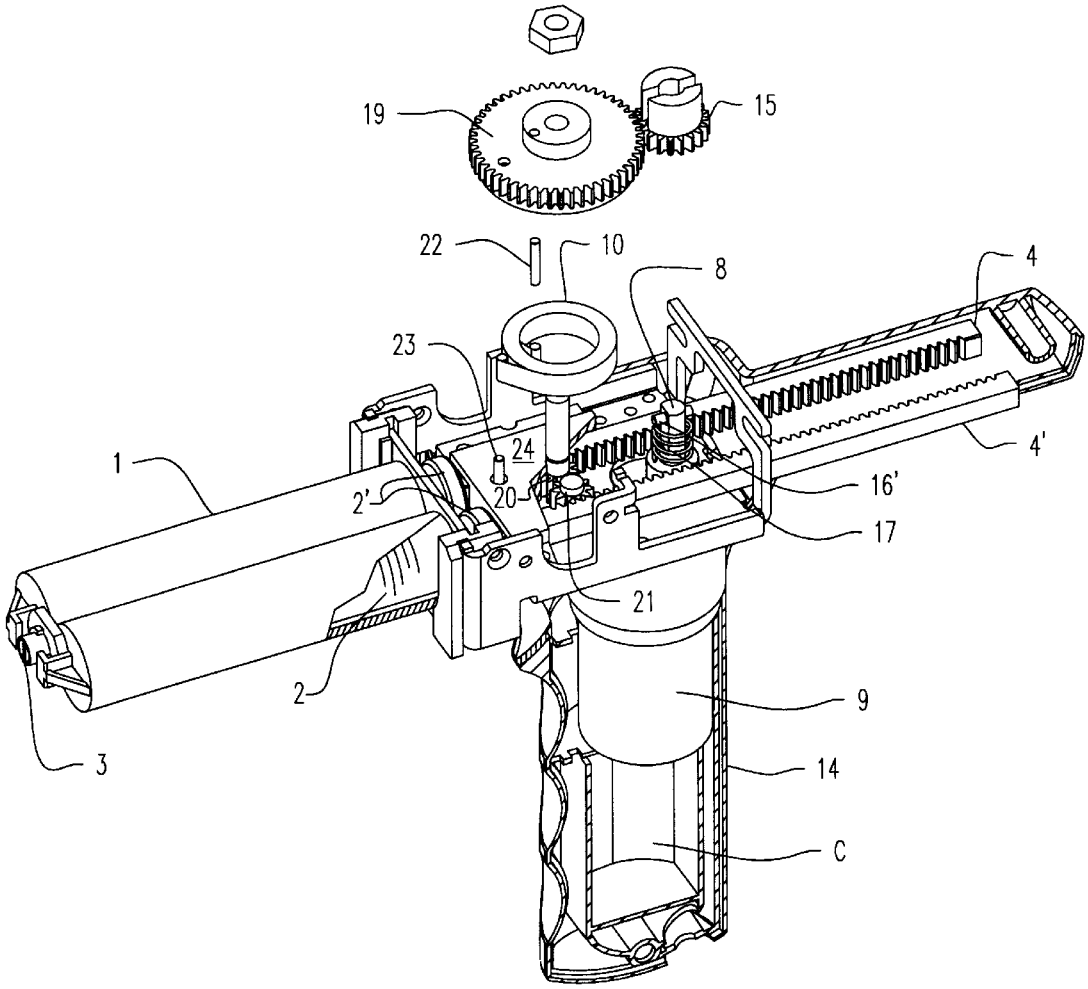
Figure 5:
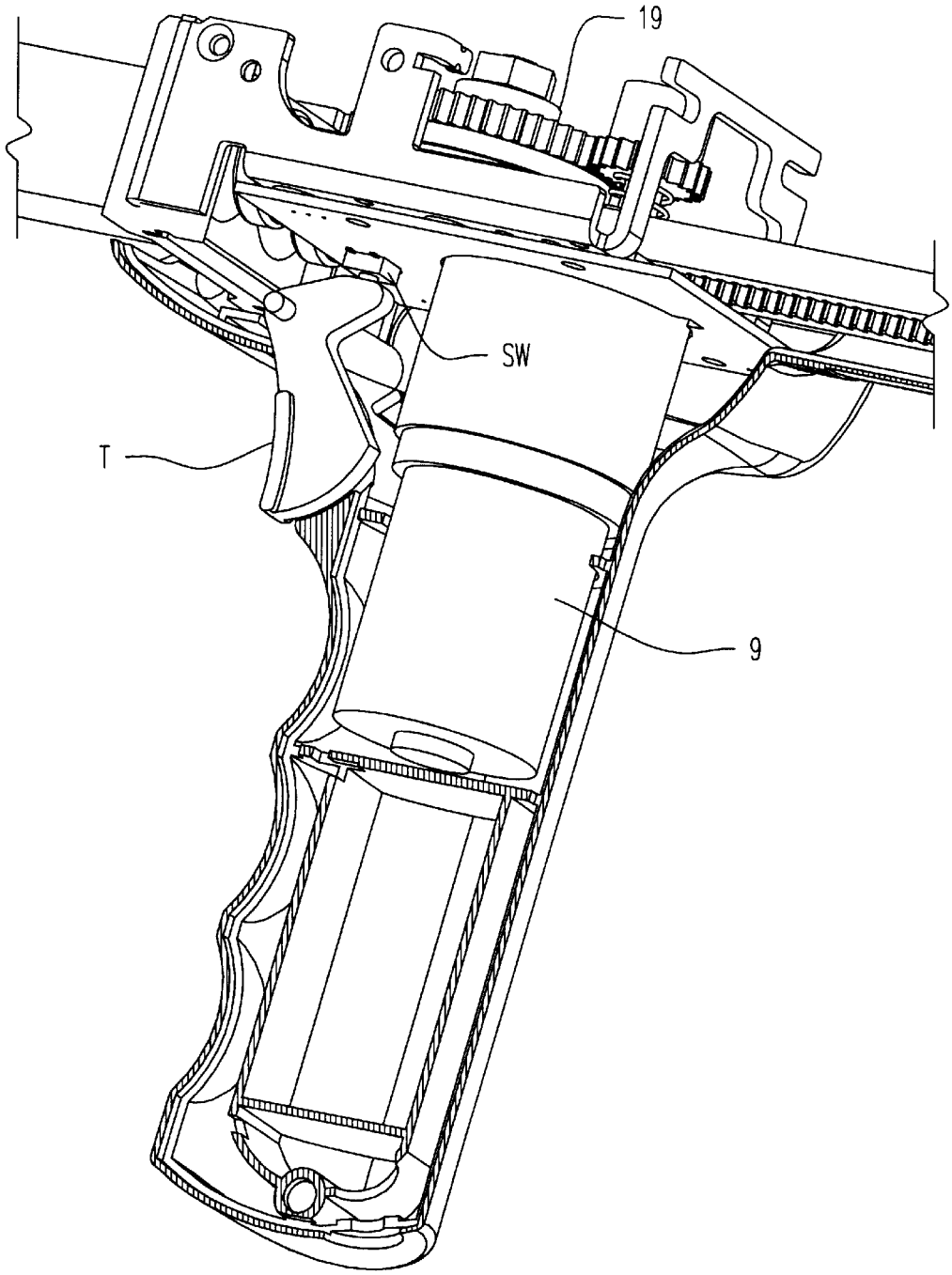
FIG. 5 is an underside view showing the trigger mechanism on the handle for operating the motor control switch.
Figure 6:
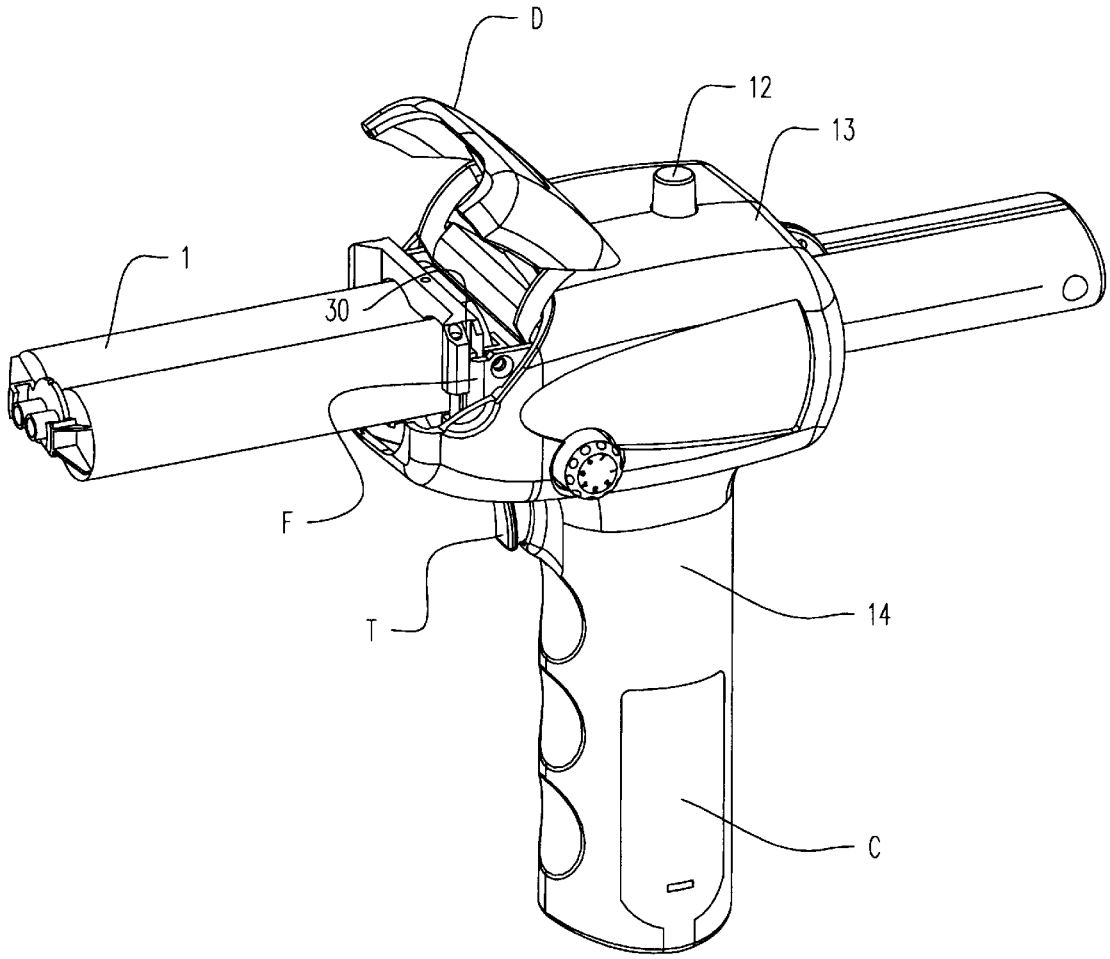
FIG. 6 shows the gun housing with its battery compartment opened and the cartridge door also in the open position.

A housed hand-held fluid dispensing gun is shown in FIG. 1 constructed along the lines of the dispenser of my earlier-referenced patent, employing a pair of in-line parallel transversely spaced longitudinal racks 4 terminating in push pads $\mathbf{2}^1$ for engaging the side-by-side pistons 2 of fluid-containing cylindrical cartridges inserted and mounted in a dual cylindrical cartridge chamber in line with and forward of the racks 4 and within a gun barrel 13 shown in FIG. 6. The chamber 1 terminates in a fluid-dispensing outlet orifice 3. Within a transversely depending handle 14, FIGS. 1 and 6, a battery compartment C and an electric motor 9 are mounted at right angles with respect to the longitudinal (horizontal) direction of the rack drive, and rack and pinion gearing, and is employed the motor shaft extending vertically from the motor at 8. As described in my earlier patent, the dispenser is operated by finger-actuating the trigger T, FIG. 5, and a retract or release button 12, FIG. 6, to retract the racks 4.

To counteract very large forces of highly viscous materials developed when the rack pushes all the way to the front (to the left in FIG. 1) as the cartridges are emptied, with a resulting lock-up under tension of the disengaging clutch that is intended to enable spring retraction, and in so doing, to enable rapid and positive retraction, the present invention, unlike the mechanism of my prior patent, attaches the release button 12 to an electronic switch SW, later more fully described in connection with FIG. 5. When the switch SW is depressed, the motor 9 is connected into reverse, releasing its pressure on the mechanism, with the pressure effecting disengagement of the drive gear and allowing the rack rapidly longitudinally to snap back under the coiled spring energy.

Figure 2:
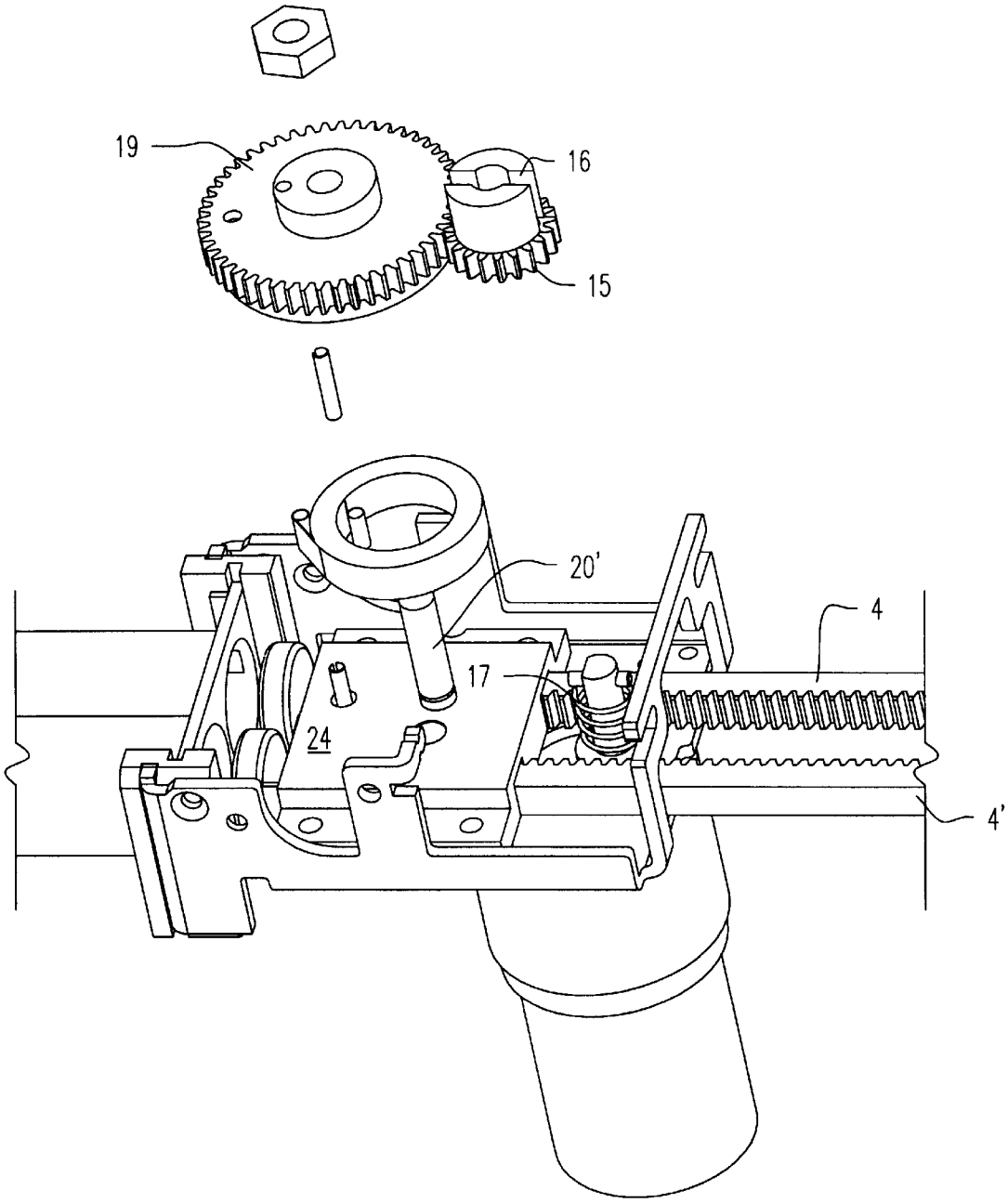
FIG. 2 is a similar view upon a somewhat enlarged scale showing the rack guide top assembly.

The motor gear 15 is designed such that it can slide up and down on the shaft 8 of the motor 9. A drive pin 16' rides in a groove 16 in the motor gear 15 and this turns the motor gear 15, though allowing the gear to drive up and down on the motor shaft, as more particularly shown in FIG. 2. The drive gear is pressed in its upper position by spring 17, pushing the motor gear up the shaft of the motor, and stopped by engaging the groove with the linking drive pin 16', FIG. 3. Thus, drive pin 16' rides in groove 16 and the spring 17 pushes the motor gear 15 up until the bottom of the groove meets or links to the pin 16'. At this point, when the motor gear is all the way to the top as far as it can go, it engages a reducing gear 19 that drives the drive gear 20. The drive gear 20, in turn, drives a rack 4 and it also turns the follow gear 21. The follow gear 21 drives the other parallel rack 4', insuring that the racks 4 and 4' are synchronized together and always move locked together. Additionally, reducing gear 19 is provided with a pin 22 that engages the flat "pancake" coil spring 10. Pin 23 also engages the flat coil spring 10, and this pin is fixed into the top of the rack guide 24.

One end of the flat coil spring 10 as used in the present invention is fixed to the rack guide top and not movable. As the reducing gear 19 rotates, it winds up the flat coil spring 10. Even at its starting point, the coil spring 10 is already under tension; so that further tensioning of the spring is added during this winding of the coil spring. When the motor gear 15 is depressed to disengage from the reducing gear 19, accordingly, the mechanism of the rack 4–4' is allowed forcefully to snap back longitudinally into its initial or resting position.

Figure 3:
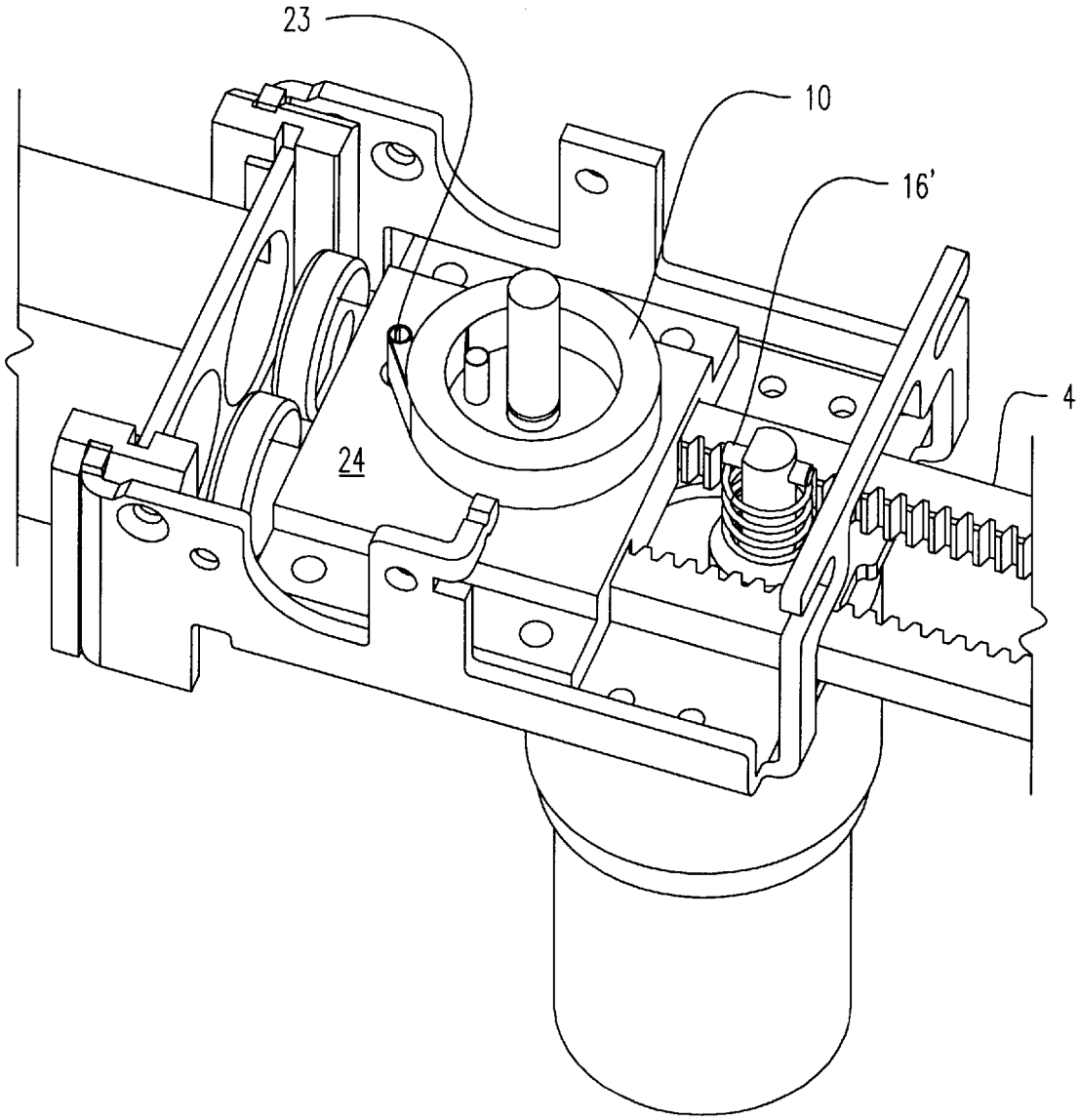
FIG. 3 is a view similar to FIG. 2 on still a further enlarged scale, illustrating the novel flat "pancake" coiled spring of the invention attached in position on top of the rack holder.
Figure 4:
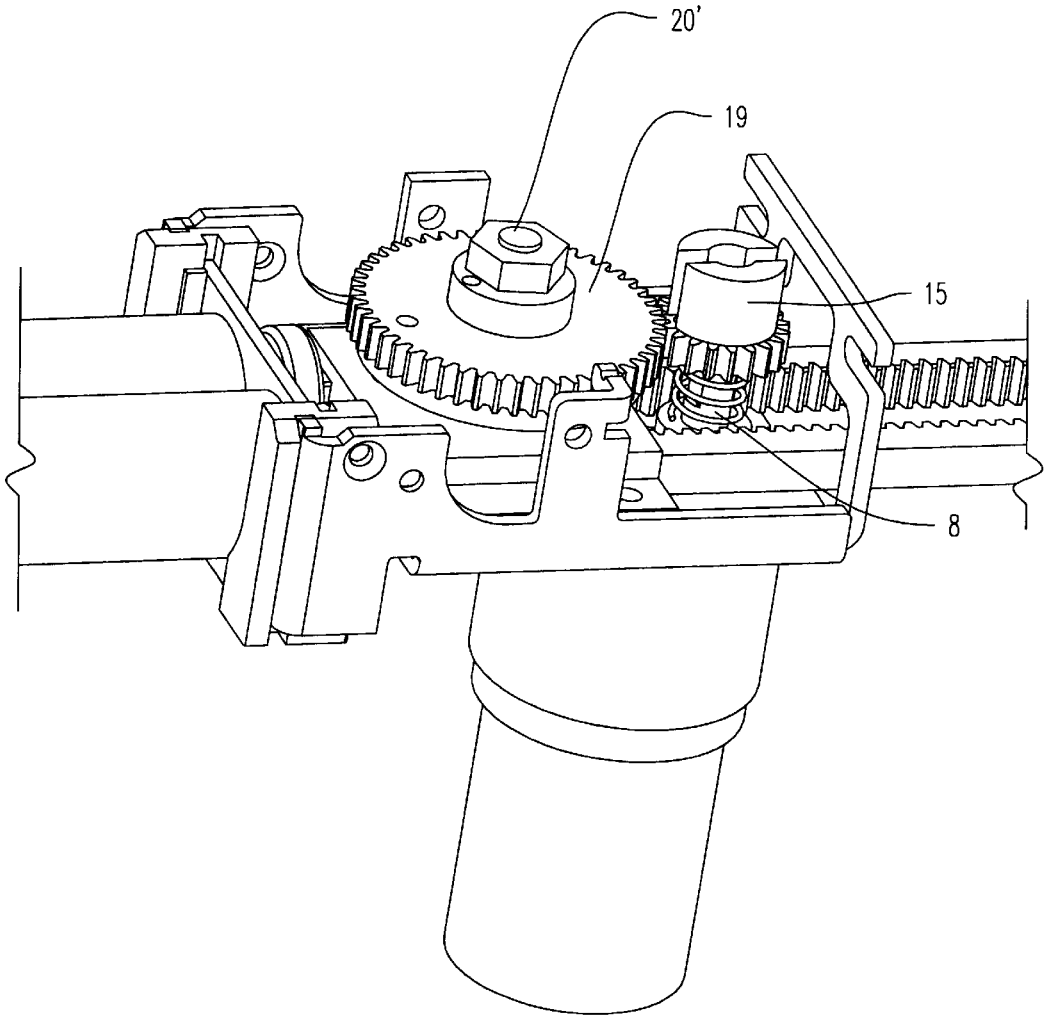
FIG. 4 is a similar view in which the motor drive gear is been shown mounted upon the rack holder or guide.

Returning to FIG. 2, the rack guide top 24 is shown placed in position to receive the racks 4 and 4' in the lower channels thereof, while the drive gear shaft 21 extends through to receive the reducing gear 19. In FIG. 3,the coil spring 10 is shown positioned on and connected at the pin 23, fixed to the rack guide top 24, and in FIG. 4, the reducing gear 19 is shown put into position to receive the drive shaft 21 and the motor gear 15 as it sits at a stop position over the drive shaft 8.

In FIG. 5, the trigger mechanism T on the inside of the gun handle is shown engaging switch SW, to energize the motor 9 as before described. In accordance with the invention, when the switch is released, the motor 9 undergoes a breaking action to slow down to zero speed, and then is connected into reverse in well-known manner. The extent of the reverse movement may be adjustable by the user. Its purpose is to release pressure on the dispensed fluid material so that it starts to flow almost immediately—an extremely important novel feature of the invention. This, indeed, allows the dispensing of very small volumes of very high viscous materials.

Figure 7:
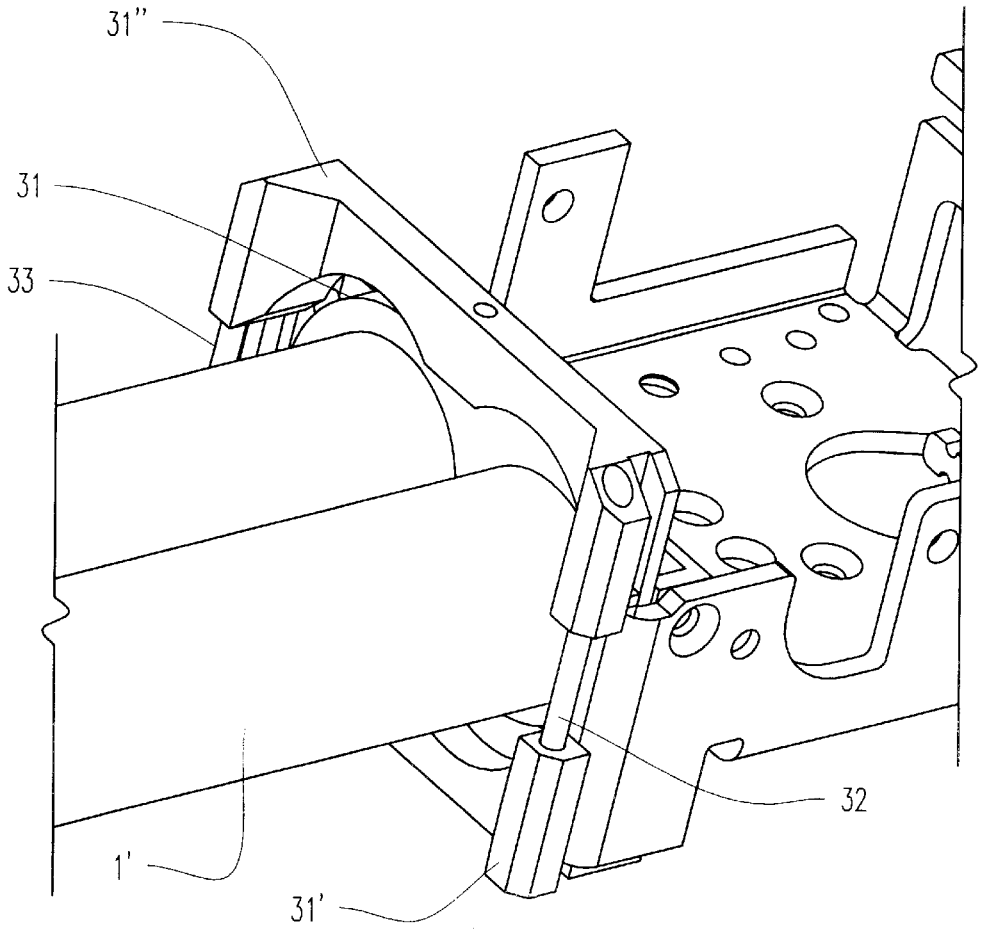
FIG. 7 is a view upon in enlarged scale of the novel universal mounting holder or gate for attaching various style cartridges.

The housing of the gun barrel 13 is shown in FIG. 6, closed in the assembled position with a forward cartridge receiving door D illustrated in open position, so that the cartridges may be inserted into or extracted from the mounting frame F. In order to give universality to the use of cartridges of different-shaped flanges with the gun of the present invention, as earlier discussed, an interchangeable cartridge retainer is provided, shown at 31 in FIG. 7, composed of a lower frame part 31' and an upper frame part 31" riding on two side edge guide pins 32 and 33, respectively, and in such a manner that it opens up only sufficiently to allow the removal of the cartridge when the gate of the retainer is open. The flat cartridge holder 31 is shown with the upper planar frame portion 31' raised on the guide pins 32 to its uppermost extremity, at which point the new cartridges 1' with different-shaped flanges may be inserted into the holder. The upper frame portion 31" is then lowered on guide pins such that the assembly may now be attached in the regular mounting grooves 30 at the forward part of the dispenser gun. This enables the use of cartridges of different manufacturers serving to provide a universal mounting structure for a common gun dispenser.

With the improved structure of the invention, dispensing even of high viscosity materials, such as impression fluid materials in dental applications or the like, can be obtained with speed control—faster than 1 ml/second for high viscosity impression materials. The dispensing may also be slowed down for dental washes or other materials, as well. The use of the trigger only to operate the switch SW, moreover, provides for less strain on the operator's wrists. Rechargeable batteries or mains operation are readily usable.

The improved features of the construction of the invention are also useful in dispensers where the dispensing may not be hand-held or operated, as well; and further modifications will also occur to those skilled in this art, such being considered to fall within the spirit and scope of the invention as defined in the appended claims.

What is claimed is:

1. In an electric motor-driven dispenser for fluid-filled cartridges wherein longitudinal racks are driven forward within a fixed rack guide to force the fluid in the cartridges to be dispensed, apparatus having, in combination, motor, reducing and drive gears; the drive gear being adapted to move the rack and the motor gear being driven by an electric motor; the reducing gear being mounted to be driven when engaged by the motor gear and driving the drive gear longitudinally to move the rack; a flat coil spring secured at one end to the top of the rack guide and connected at its other end to the reducing gear so as to be tensioned as the motor gear is spring-urged into engagement with the reducing gear to drive the reducing gear, and to be released upon disengagement from the motor gear; and a spring-controlled release mechanism actuable upon the dispensing of the fluid from the cartridges for dis-engaging the motor gear from the reducing gear to enable the flat coil spring retraction of the racks longitudinally within the rack guide.

2. Apparatus as claimed in claim 1 wherein a trigger switch is provided to operate the motor to drive the motor gear and effect the fluid dispensing in response to the longitudinal movement of the racks into engagement with the cartridges.

3. Apparatus as claimed in claim 2 wherein, upon release of the trigger switch, means is provided for reversing direction of the electric motor to slowdown and then reverse the rack drive to release pressure on the cartridge-dispensed fluid.

4. Apparatus as claimed in claim 3 wherein means is provided for adjusting the extent of said reversing.

5. Apparatus as claimed in claim 3 wherein upon operation of the release mechanism, there follows said reverse direction operation of the motor.

6. Apparatus as claimed in claim 2 wherein the spring-urged engagement of the motor gear with the reducing gear is effected by pin and groove links enabling up and down movement on the motor shaft.

7. Apparatus as claimed in claim 2 wherein the connection of said other end of the coil spring to the reducing gear is effected by pin links.

8. Apparatus as claimed in claim 1 wherein the fluid-filled cartridges are provided with rear flanges transversely slidably mountable in a flat-cartridge holder positioned forward of the rack guide; the cartridge holder having lower and upper planar frame portions laterally adjustably movable on edge guide pins to enable the insertion and locking of different-shaped cartridge rear flanges therebetween for universality of cartridge mounting in the dispenser.

9. Apparatus as claimed in claim 8 wherein the housing encloses the dispenser with a forward hinged cover provided for enabling the insertion and attachment thereunder of the cartridge holder.

* * * * *